US007918118B2

(12) United States Patent
Golovashchenko

(10) Patent No.: US 7,918,118 B2
(45) Date of Patent: Apr. 5, 2011

(54) METHOD OF USING AN ELECTROMAGNETIC FORMING MACHINE TO HEM A PLURALITY OF PANELS TO FORM A PANEL ASSEMBLY

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 449 days.

(21) Appl. No.: 12/115,019

(22) Filed: May 5, 2008

(65) Prior Publication Data

US 2009/0272166 A1 Nov. 5, 2009

(51) Int. Cl.
*B21D 26/02* (2006.01)

(52) U.S. Cl. ..... 72/56; 72/430; 72/707; 72/316; 29/419.2; 29/509

(58) Field of Classification Search ..... 72/306, 72/312, 313, 314, 315, 386, 56, 430, 707; 29/505, 509, 243.58, 419.2; 219/603
See application file for complete search history.

(56) References Cited

U.S. PATENT DOCUMENTS

| | | | | |
|---|---|---|---|---|
| 458,115 | A | 8/1891 | Thomson | |
| 1,541,924 | A | 6/1925 | d'Adrian | |
| 3,762,904 | A | 10/1973 | Hamilton et al. | |
| 3,794,805 | A * | 2/1974 | Rudd | 219/152 |
| 3,795,501 | A | 3/1974 | Jansson et al. | |
| 3,879,184 | A | 4/1975 | Hamilton et al. | |
| 4,175,228 | A | 11/1979 | Bizzari et al. | |
| 4,531,393 | A | 7/1985 | Weir | |
| 5,237,734 | A * | 8/1993 | Polon | 29/513 |
| 5,671,522 | A * | 9/1997 | Aronne | 29/419.2 |
| 5,948,185 | A | 9/1999 | Krajewski et al. | |
| 6,227,023 | B1 | 5/2001 | Daehn et al. | |
| 6,463,779 | B1 | 10/2002 | Terziakin | |
| 6,513,240 | B1 * | 2/2003 | Seidel | 29/890.039 |
| 6,927,370 | B2 * | 8/2005 | McClure et al. | 219/603 |
| 7,165,429 | B2 | 1/2007 | Steingroever | |
| 7,240,532 | B2 | 7/2007 | Zhang et al. | |

(Continued)

FOREIGN PATENT DOCUMENTS

FR 2632218 * 6/1988

OTHER PUBLICATIONS

"The Proceedings of the 1998 Japanese Spring Conference for the Technology of Plasticity", May 13-15, 1998, Osaka, Japan, The Japan Society for Technology of Plasticity.

(Continued)

*Primary Examiner* — Edward Tolan
(74) *Attorney, Agent, or Firm* — Raymond L. Coppiellie; Brooks Kushman P.C.

(57) ABSTRACT

A method of using an electromagnetic forming machine to hem a panel assembly includes providing an inner panel and an outer panel. The outer panel has a plurality of flanges and a plurality of relief areas. An electric forming machine is provided having a coil for discharging electric energy to generate a magnetic field. The inner panel is positioned such that portions of the outer edge of the inner panel are aligned with the flanges of the outer panel to form a loose assembly of panels. The loose assembly of panels is positioned proximate the electromagnetic forming machine such that the coil surrounds the flanges and is disposed substantially coplanar with a plane formed by the relief areas. The electromagnetic forming machine is activated to generate a magnetic field causing the flanges to bend over.

15 Claims, 9 Drawing Sheets

U.S. PATENT DOCUMENTS

| | | | | |
|---|---|---|---|---|
| 7,263,757 | B2 * | 9/2007 | Herman | 29/509 |
| 7,290,318 | B2 * | 11/2007 | Bradley et al. | 29/419.2 |
| 2005/0229376 | A1 | 10/2005 | Herman | |
| 2005/0229377 | A1 | 10/2005 | Bradley et al. | |
| 2007/0084261 | A1 | 4/2007 | Golovashchenko | |

OTHER PUBLICATIONS

"Electrically Induced Creeping and Bending Deformation of Plasticized Poly(vinyl chloride)", Md. Zulhash Uddin, et al. Chemistry Letters 2001, pp. 360-361, The Chemical Society of Japan.

" Formability of Sheet Metal with Pulsed Electromagnetic and Electrohydraulic Technologies", S.F. Golovashchenko, et al., Proceedings of TMS Symposium "Aluminum-2003", San Diego, CA 2003.

"The Effect of Tool/Sheet Interaction in Damage Evolution of Electromagnetic Forming of Aluminum Alloy Sheet", J. Imbert et al, Transactions ASME, Journal of Engineering Materials and Technology, Jan. 2005, vol. 127, pp. 145-153.

* cited by examiner

METHOD OF USING AN ELECTROMAGNETIC FORMING MACHINE TO HEM A PLURALITY OF PANELS TO FORM A PANEL ASSEMBLY

BACKGROUND OF THE INVENTION

1. Field of the Invention

The present invention relates to the field of using an electromagnetic forming machine to form a panel assembly by using the repulsive force of opposing magnetic fields to hem the panels together.

2. Background Art

The joining of inner and outer panels to make a panel assembly by hemming flanges on the outer panel over onto the inner panel using mechanical forces, such as those applied by a double action press, is well known in the art. In some instances, however, the exterior panel may lack sufficient formability needed to provide a sharp hemming radius. Additionally, the use of mechanical force to hem inner and outer panels together may result in unacceptably long cycle times. The present invention addresses these issues.

SUMMARY OF THE INVENTION

A method of using an electromagnetic forming machine to hem a plurality of panels to form a panel assembly is disclosed. In a first example, an inner panel is provided. The inner panel has an outer edge. An outer panel is also provided. The outer panel has a central portion, a plurality of flanges disposed around a periphery of the central portion and a plurality of relief areas. Each relief area is disposed between adjacent flanges and has an upper surface. An electromagnetic forming machine is provided. The electromagnetic forming machine has a coil for discharging electric energy to generate an electromagnetic force. The inner panel is positioned adjacent the outer panel such that the portions of the outer edge of the inner panel are aligned with the flanges of the outer panel and spaced apart therefrom to form a loose assembly of panels. The loose assembly of panels is positioned proximate the electromagnetic forming machine such that the coil surrounds the plurality of flanges and is disposed generally below a plane formed by the upper surface of the plurality of relief areas. The electromagnetic forming machine is activated to generate an electric current in the coil which induces an opposing electric current in each of the flanges whereby each of the flanges are bent over the outer edge of the inner panel to form a hem.

In some implementations of the first embodiment, while positioning the loose assembly of panels proximate the electromagnetic forming machine, the loose assembly of panels may be disposed such that no portion of the coil protrudes above the plane formed by the upper surface of the plurality of the relief areas. In some implementations, the electromagnetic forming machine comprises a single turn coil. The single turn coil may have a varying cross section along a length of the single turn coil such that the single turn coil comprises a plurality of thick portions and a plurality of thin portions. During the positioning step, the thin portions may be aligned with the relief areas. Also, an upper surface of each of the thin portions may be positioned below the plane formed by the upper surface of each of the relief areas. In some implementations, an upper surface of at least some of the thick portions may extend above the plane formed by the upper surface of each of the relief areas.

In other implementations, the inner panel and the outer panel may be clamped together after the inner panel has been positioned adjacent the outer panel.

In a second example, the method includes providing an inner panel having an outer edge. An outer panel having a central portion, a plurality of flanges disposed around a periphery of the central portion, and a plurality of relief areas is provided. Each relief area is disposed between adjacent flanges. A double action press is provided. An electromagnetic forming machine is provided. The electromagnetic forming machine has a coil for discharging electric energy. The outer panel is positioned in the double action press which clamps the blank to prevent movement of the outer panel. The flanges of the outer panel are bent with the double action press until the flanges are disposed in a non-coplanar angular orientation with respect to the central portion. The inner panel is positioned adjacent the outer panel such that portions of the outer edge of the inner panel are aligned with the flanges of the outer panel and spaced apart therefrom to form a loose assembly of panels. The loose assembly of panels is positioned proximate the electromagnetic forming machine such that the coil surrounds the plurality of flanges and is disposed generally below a plane formed by an upper surface of the plurality of relief areas. The electromagnetic forming machine is activated to generate magnetic fields in the coil which induces an opposing magnetic field in each of the flanges whereby the flanges are bent over the outer edge of the inner panel to form a hem.

In some implementations, during the step of positioning the loose assembly of panels proximate the electromagnetic forming machine, the loose assembly of panels may be disposed such that no portion of the coil protrudes above the plane formed by the upper surface of the plurality of the relief areas. In some implementations, the electromagnetic forming machine may comprise a single coil. The single coil may have a varying cross section along a length of the single coil such that the single coil comprises a plurality of thick portions and a plurality of thin portions. During the positioning step, the thin portions may be aligned with the relief areas. In some instances, an upper surface of each of the thin portions is positioned below the plane that is formed by the upper surface of each of the relief areas.

In some instances, the method further includes the step of clamping the inner panel and the outer panel together after the inner panel has been positioned adjacent the outer panel. In some instances, the flanges are bent until they are disposed substantially perpendicular to the central portion.

In a third example, a method of using an electromagnetic forming machine to hem a plurality of panels to form a panel assembly is disclosed. The method includes providing an inner panel having an outer edge. An outer panel having a central portion and a plurality of flanges disposed around an outer portion is provided. The flanges are disposed at a non-coplanar angular orientation with respect to the central portion. Each flange has a first end and a second end. The outer panel further includes a plurality of relief areas. Each relief area is disposed between adjacent flanges. An electromagnetic forming machine is provided. The electromagnetic forming machine has a plate for directing the flow of electric current. The plate has a first end and a second end. The electromagnetic forming machine further has a current generator. The current generator directs current into the first end of the plate when the electromagnetic forming machine is activated. The inner panel is positioned adjacent the outer panel such that portions of the outer edge of the inner panel are aligned with the flanges at the outer panel and spaced apart therefrom to form a loose assembly of panels. The plate of the electromagnetic forming machine is positioned proximate one of the flanges. The second end of the plate is electrically connected to the second end of the one of the flanges. The first end of the one of the flanges is electrically connected to the current generator of the electromagnetic forming machine. The electromagnetic forming machine is activated to direct an electric current that travels from the current generator to the first end of the plate to the second end of the plate to the second end of the one of the flanges to the first end of the one of the flanges and back to the current generator whereby opposing magnetic fields are produced by the plate and the flange, respectively, which repel one another and which force the flange to bend over the outer edge of the inner panel to form a hem.

In some implementations, the plate may be disposed substantially parallel to the one of the flanges when the plate is positioned proximate the one of the flanges. Also, the method may further comprise the step of disposing an insulating member between the plate and the one of the flanges.

In some examples, the one of the flanges may include a first tab protruding from the first end and a second tab protruding from the second end. The second end of the plate may be electrically connected to the second tab and the current generator may be connected to the first tab. In some examples, the first and the second tabs may be sheared off as the flange bends over the outer edge of the inner panel when the hem is formed.

BRIEF DESCRIPTION OF THE DRAWINGS

The description herein makes reference to the accompanying drawing wherein like reference numerals refer to like parts through the several views, and in which.

DETAILED DESCRIPTION OF THE ILLUSTRATED EMBODIMENT(S)

Detailed embodiments of the present invention are disclosed herein; however, it is to be understood that the disclosed embodiments are merely exemplary of the invention that may be embodied in various and alternative forms. The figures are not necessarily drawn to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

The use of electromagnetic forming machines to hem panels assemblies is well known in the art. Various electromagnetic forming processes are disclosed in U.S. Pat. Nos. 6,927,370; 6,463,779; 4,531,393; 4,175,228; 3,879,184; 3,795,501; 3,762,904; 1,541,924; and 458,115; and U.S. Publication Nos. 2007/0084261; 2005/0229376; and 2005/0229377, each of which is hereby incorporated herein by reference. Electromagnetic forming uses electric current pulses, typically very high current, in an electric coil to generate magnetic fields. When the electric coil is disposed in close proximity to an electrically conductive metal workpiece, such as an aluminum alloy or a steel workpiece, the magnetic fields generated by the electric coil will induce an opposing electric current in the metal workpiece. The opposing electric current, in turn, generates an opposing magnetic field. The electric field generated by the electric coil and the opposing magnetic field generated by the induced current in the metal workpiece repel one another. When the coil is held in a fixed position, the repulsive magnetic forces act on the workpiece causing it to deform in a direction away from the coil.

In the present invention, an electromagnetic forming machine utilizes a coil that surrounds the metal workpiece to simultaneously deform a plurality of flanges disposed at various intervals around a periphery of the workpiece. In another embodiment of the invention, the electromagnetic forming machine includes a plate rather than a coil. The plate is electrically connected to the portion of the metal workpiece that is to be deformed. Current is then passed through the plate in one direction and then into and through a portion of the metal workpiece in the opposite direction. The oppositely directed currents generate opposing magnetic fields which repel one another. When the plate is held is a fixed position, the repulsive magnetic force acts on the workpiece causing it to deform in a direction away from the plate.

Figure 1:
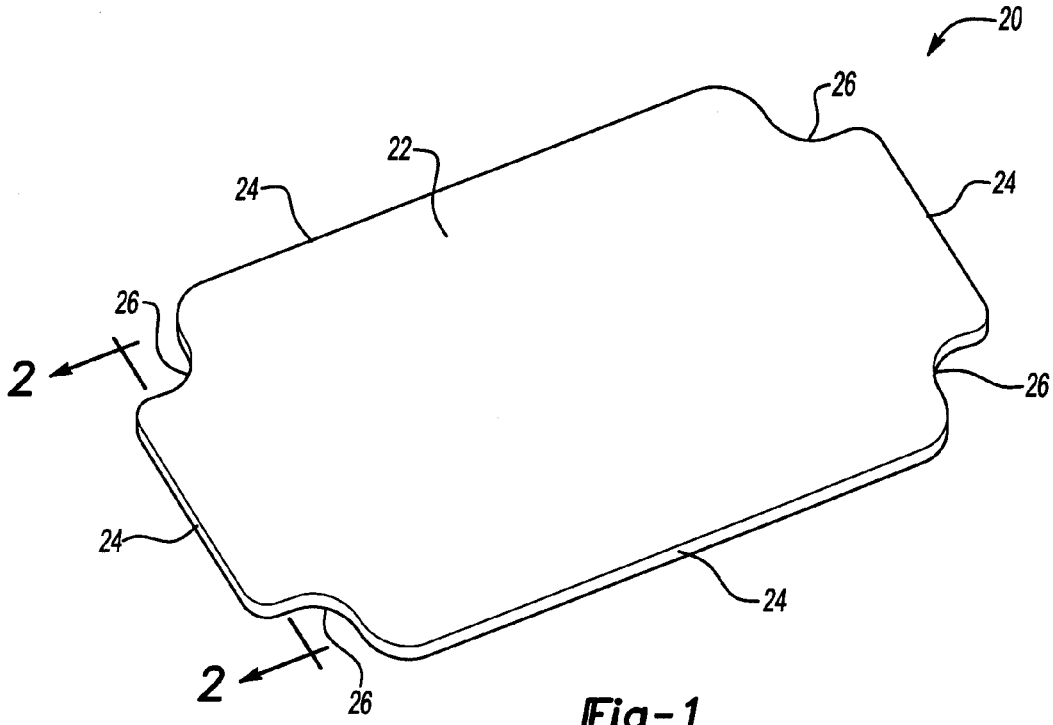
FIG. 1 is perspective view illustrating an outer panel having a plurality of flanges prior to bending the flanges.

Examples of the method of the present invention will now be addressed. With reference to FIG. 1, an outer panel 20 is illustrated. Outer panel 20 includes a central portion 22 and a plurality of flanges 24 projecting outwardly from central portion 22 and extending along a length of a periphery of central portion 22. Outer panel 20 may be made of materials comprising metals including aluminum, steel, and aluminum alloys 6111-T4; 6022-T4; 6016-T4; and steels DDQ; EDDQ; BH210; BH180; DP500; and magnesium. A plurality of reliefs 26 are disposed between adjacent flanges 24. Each individual relief 26 provides a space or void to permit flanges 24 to be folded over without interference from adjacent flanges 24.

Figure 2:
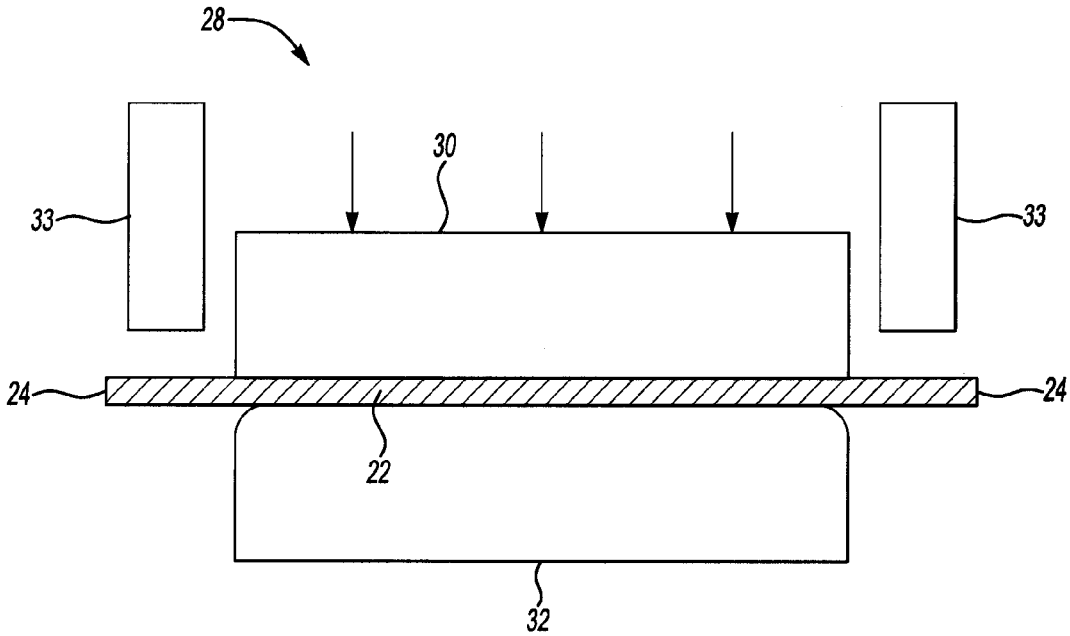
FIG. 2 is a cross sectional view of the outer panel of FIG. 1 positioned in a double action press prior to bending the flanges.

With respect to FIG. 2, a double action press 28 is depicted. Outer panel 20 is disposed between an upper portion 30 and a lower portion 32. Upper portion 30 is brought down on top of outer panel 20 to clamp it against lower portion 32 to substantially immobilize it therewith. When outer panel 20 is clamped between upper and lower portions 30, 32, flanges 24 protrude outwardly beyond an outer edge of upper and lower portions 30, 32. Bending members 33 are disposed adjacent outer portions of upper and lower portions 30, 32 and are positioned over protruding flanges 24. As bending members 33 move in a downward direction, flanges 24 are bent downward.

Figure 3:
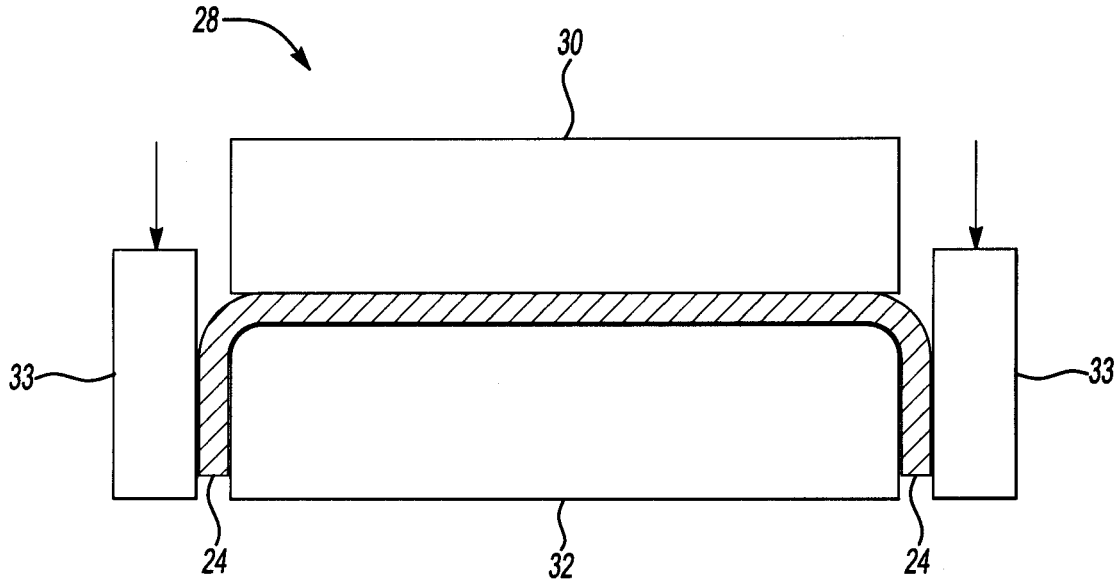
FIG. 3 is a cross sectional view of the outer panel of FIG. 1 positioned in the double action press of FIG. 2 subsequent to bending the flanges.

With respect to FIG. 3, outer panel 20 is illustrated after double action press 28 has completed a cycle. In this illustration, flanges 24 have been bent with respect to central portion 22 in a downward direction and are substantially perpendicular to central portion 22. In other embodiments, flanges 24 may be bent at a non-coplanar angle other than 90□ with respect to central portion 22. Upon completion of the cycle, upper portion 30 is raised and outer panel 20 is removed from double action press 28.

Figure 4:
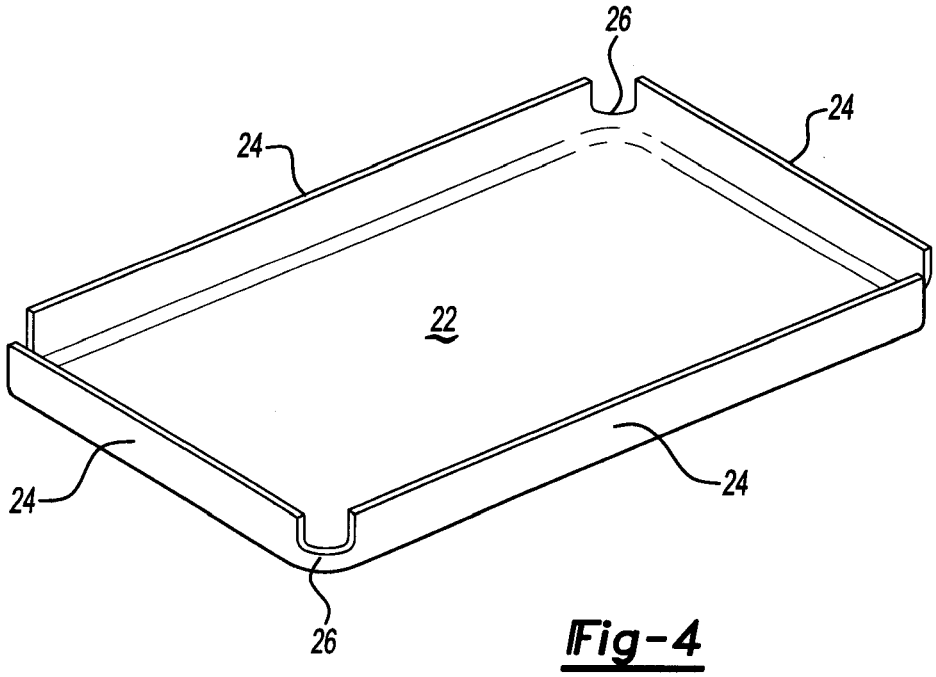
FIG. 4 is a perspective view of the outer panel of FIG. 1 subsequent to the bending of the flange portions.

In FIG. 4, outer panel 20 is illustrated subsequent to operation of double action press 28. In this view, flanges 24 can be seen bent to substantially 90□ with respect to central portion 22. Reliefs 26 can be seen disposed between adjacent flanges 24.

Figure 5:
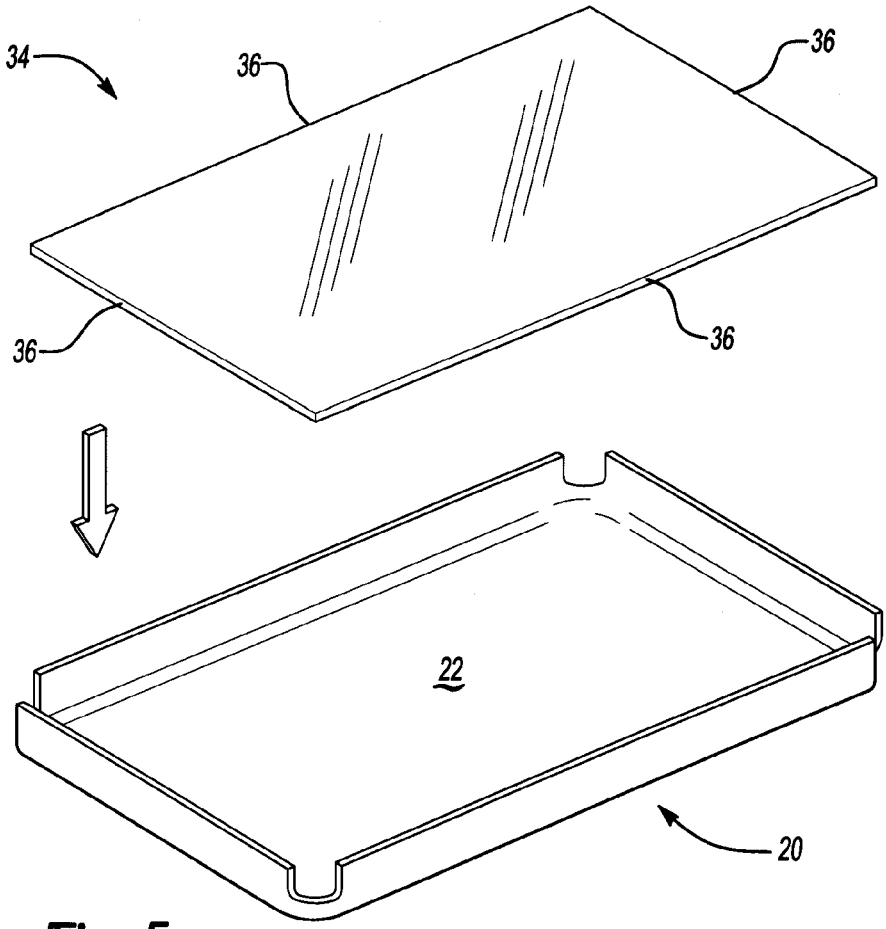
FIGS. 5 and 6 illustrate a provision of an inner panel and the alignment of the inner panel with the outer panel.

With respect to FIG. 5, an inner panel 34 is provided. Inner panel 34 has generally the same shape as central portion 22. Inner panel 34 is dimensioned to be slightly smaller in length and width than a corresponding length and width of central portion 22. By providing inner panel 34 with smaller dimensions than central portion 22, a gap, known as a marriage gap, is formed between an outer edge 36 of inner panel 34 and an internal face of each flange 24.

Figure 6:
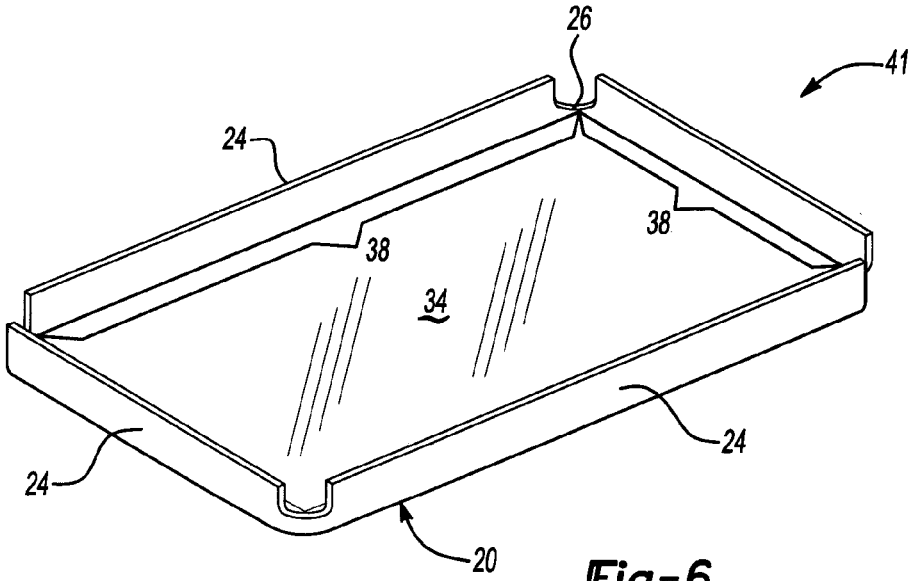

With respect to FIG. 6, inner panel 34 has been positioned adjacent outer panel 20, within a portion bounded by flanges 24 and central portion 22. In the illustrated embodiment, outer edge 36 includes four outer edge portions 38 which substantially align with a respective flange 24 and spaced apart from flange 24 by marriage gap 40 (see FIG. 12). The corners of inner panel 34 are substantially aligned with reliefs 26 and an upper surface 27 of each relief 26 is generally co-planar with an upper surface of inner panel 34. When inner panel 34 positioned with respect to outer panel 20 in the manner described above, a loose assembly of panels 41 is formed.

In the illustrated embodiment, inner panel 34 and central portion 22 are substantially rectangular. It should be understood by those of ordinary skill in the art that central portion 22 and inner panel 34 may have any desirable shape without departing from the teachings of the present invention. Inner panel 34 is substantially centered on central portion 22 and each outer edge portion 38 is substantially equidistant from its respective flange 24.

Figure 7A:
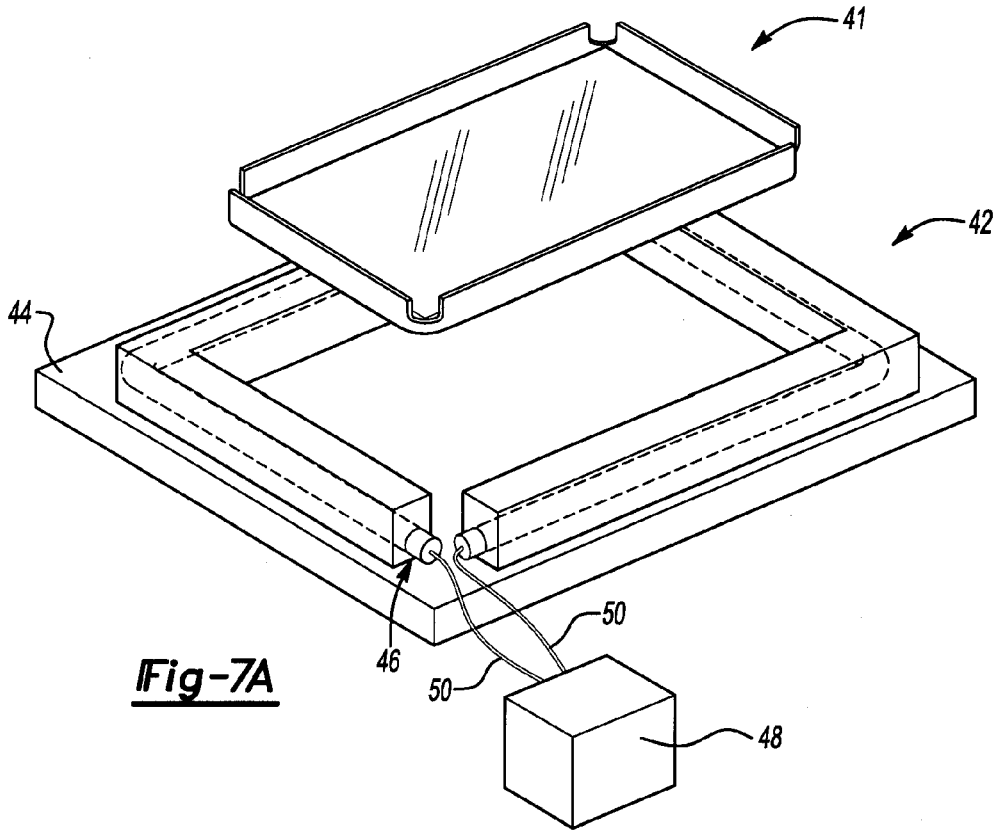
FIG. 7A is a perspective view illustrating the provision of an electromagnetic forming machine and the alignment of the loose panel assembly of FIG. 6 on the electromagnetic forming machine.

With respect to FIG. 7A, an electromagnetic forming machine 42 is provided. Electromagnetic forming machine 42 includes a table portion 44 a coil assembly 46, an electric current generator 48 and wires 50 (for example, a coaxial cable) joining electric current generator 48 to coil assembly 46. Coil assembly 46 includes a coil 52 and a housing 54. Coil 52 has a substantially constant cross section along its entire length. In the illustrated embodiment, coil assembly 46 includes only a single coil. In other embodiments, a plurality of coils may be employed. In other embodiments, coil assembly 46 may include a coil having varying cross sectional geometries and dimensions. In some embodiments, electric current generator 48 includes a plurality of capacitors which store a relatively large electric current. When electric current generator 48 is discharged, the current flows through wires 50 into coil 52. The flow of electric current through coil 52 generates a magnetic field propagating outwardly from coil 52. The current discharged into coil 52 is relatively large. In some embodiments, the electric current may reach from 10 k Amps up to 1000 k Amps. The stronger the electric current that flows through coil 52, the stronger will be the magnetic field generated by coil 52. Housing 54 may provide insulation for coil 52.

Figure 7B:
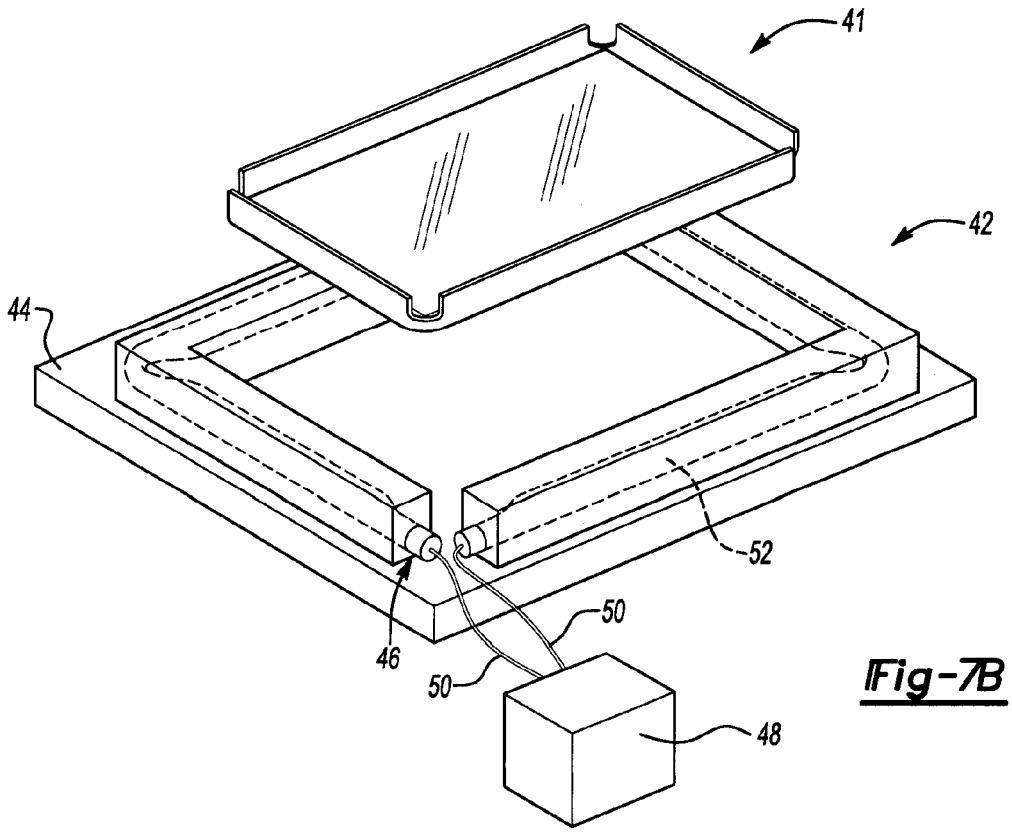
FIG. 7B is a perspective view illustrating the provision of an alternate embodiment of the electromagnetic forming machine of FIG. 7A.

With respect to FIG. 7B, an alternate embodiment of the electromagnetic forming machine 42 is illustrated. In this embodiment, coil 52 has a varying cross section. Coil 52 has a generally thinner cross sectional dimension at its corners to correspond with the lower height of relief 26 of loose assembly of panels 41.

Figure 8:
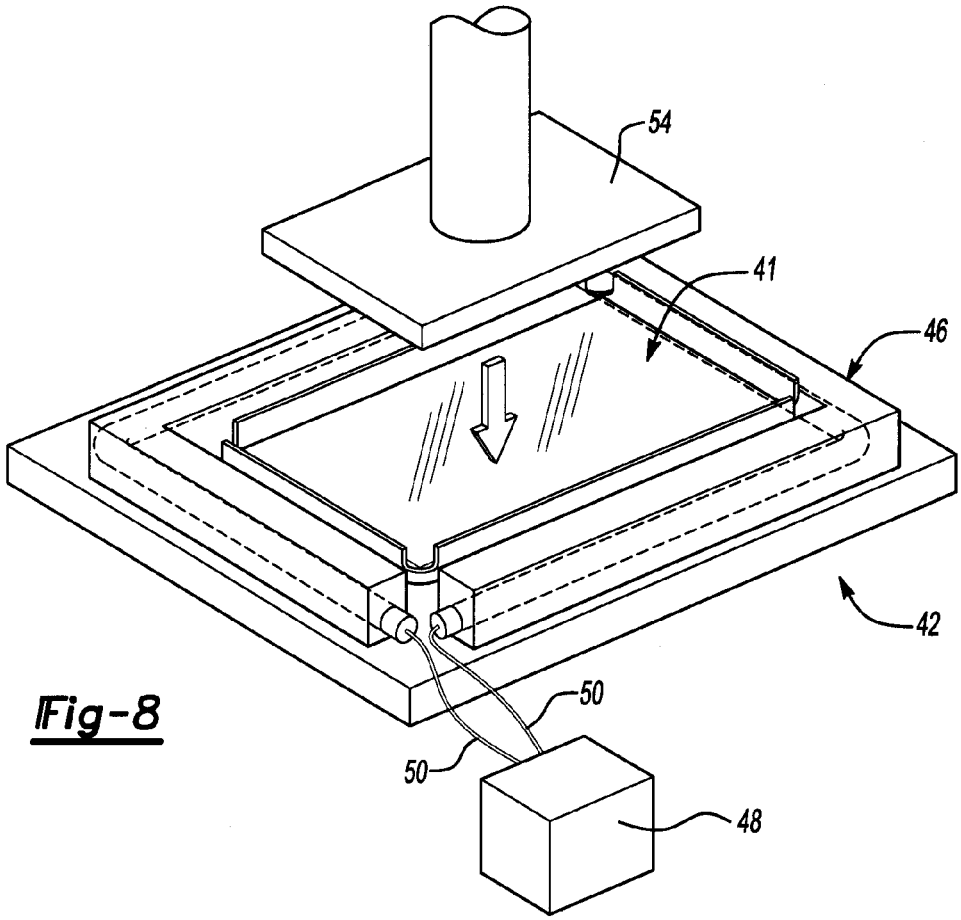
FIGS. 8-10 are perspective views illustrating the steps of clamping the loose assembly of panels to one another on the electromagnetic forming machine of FIG. 7A, the activation of the electromagnetic forming machine to form a hem between the outer panel and the inner panel and the removal of the completed panel assembly from the electromagnetic forming machine.

With respect to FIG. 8, loose assembly of panels 41 is positioned on table 44 such that it is surrounded on all four sides by coil assembly 46. Loose assembly 41 is substantially centered within an area interior of coil assembly 46. Reliefs 26 are aligned with the thinner portions of coil 52. In the illustrated embodiment, an upper surface of the thinner portions of coil 52 form a plane that does not protrude above a plane formed by the upper surfaces 27 of reliefs 26. The thicker portions of coil 52 are aligned with flanges 24. As electric current travels through the coil 52, and magnetic fields propagate outwardly from coil 52 into flanges 24, electric current is induced within, and travels around, outer an outer portion of outer panel 20 including flanges 24 and reliefs 26. If the thin portions of coil 52 were to protrude above upper surfaces 27 of their corresponding reliefs 26, the electric current induced in outer panel 20 by the magnetic field propagating outwardly from coil 52 may be erratic and unpredictable. By insuring that no portion of coil 52 protrudes above an upper surface 27 of a relief 26, the induced electric current is predictable and the electromagnetic force generated by electromagnetic forming machine 42 may be accurately controlled and directed. A clamp 54 may be part of the electromagnetic forming machine 42 or may be separate therefrom. Clamp 54 is brought down on top of loose assembly of panels 41 to fix the position of inner panel 34 with respect to outer panel 20 while electromagnetic force machine 42 is activated.

Figure 9:
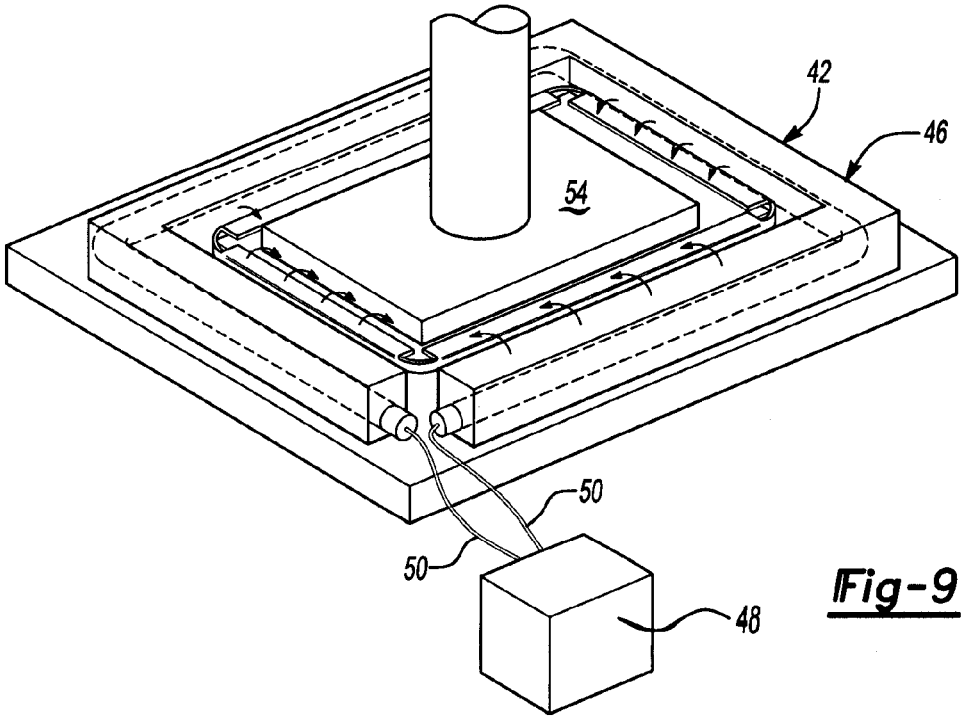

With respect to FIG. 9, clamp 54 has moved down and clamps inner panel 34 and outer panel 20 to table 44, immobilizing inner panel 34 with respect to outer panel 20. Electromagnetic forming machine 42 is activated sending an electric current through coil 52 which, in turn, generates a magnetic field propagating outwardly from coil 52 which, in turn, induces an oppositely oriented electric current in an outer perimeter of loose assembly of panels 41 which in turn generates an opposing magnetic field that is repelled by the magnetic field propagating outwardly from coil 52. As a result, flanges 24 are bent over onto inner panel 34 forming a hem. Relief portions 26 are driven inwardly against the corners of inner panel 34.

Figure 10:
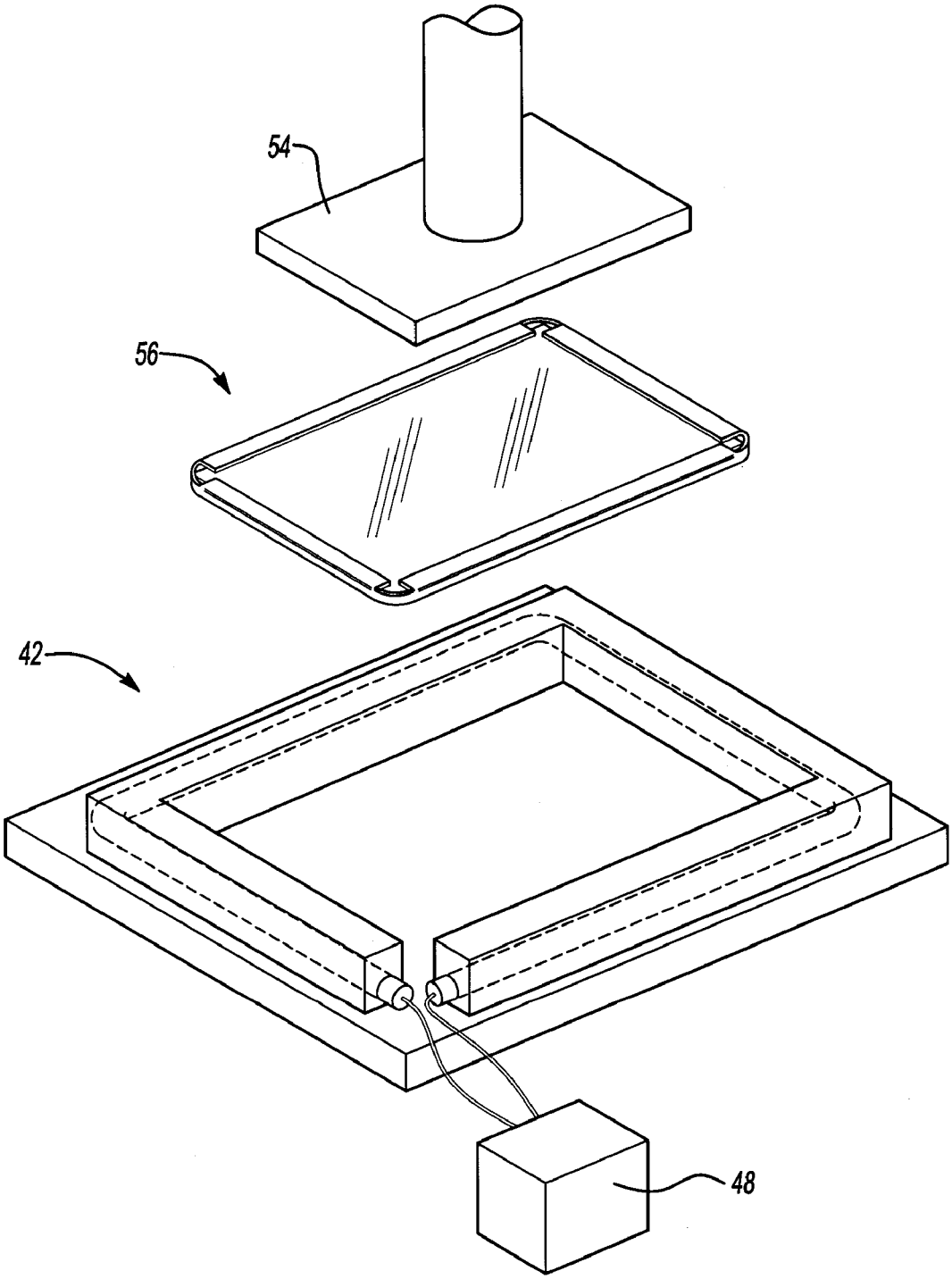

With respect to FIG. 10, single action press or clamp 54 is lifted and hemmed panel assembly 56 is removed from electromagnetic forming machine 42. The process described above may be used in any industry where it is desirable to join inner and outer panels by magnetic force. For example, the above described process may be useful in the automotive industry to form door panels, hood panels, trunk lid panels, and hatchback panels, just to name a few.

Figure 11:
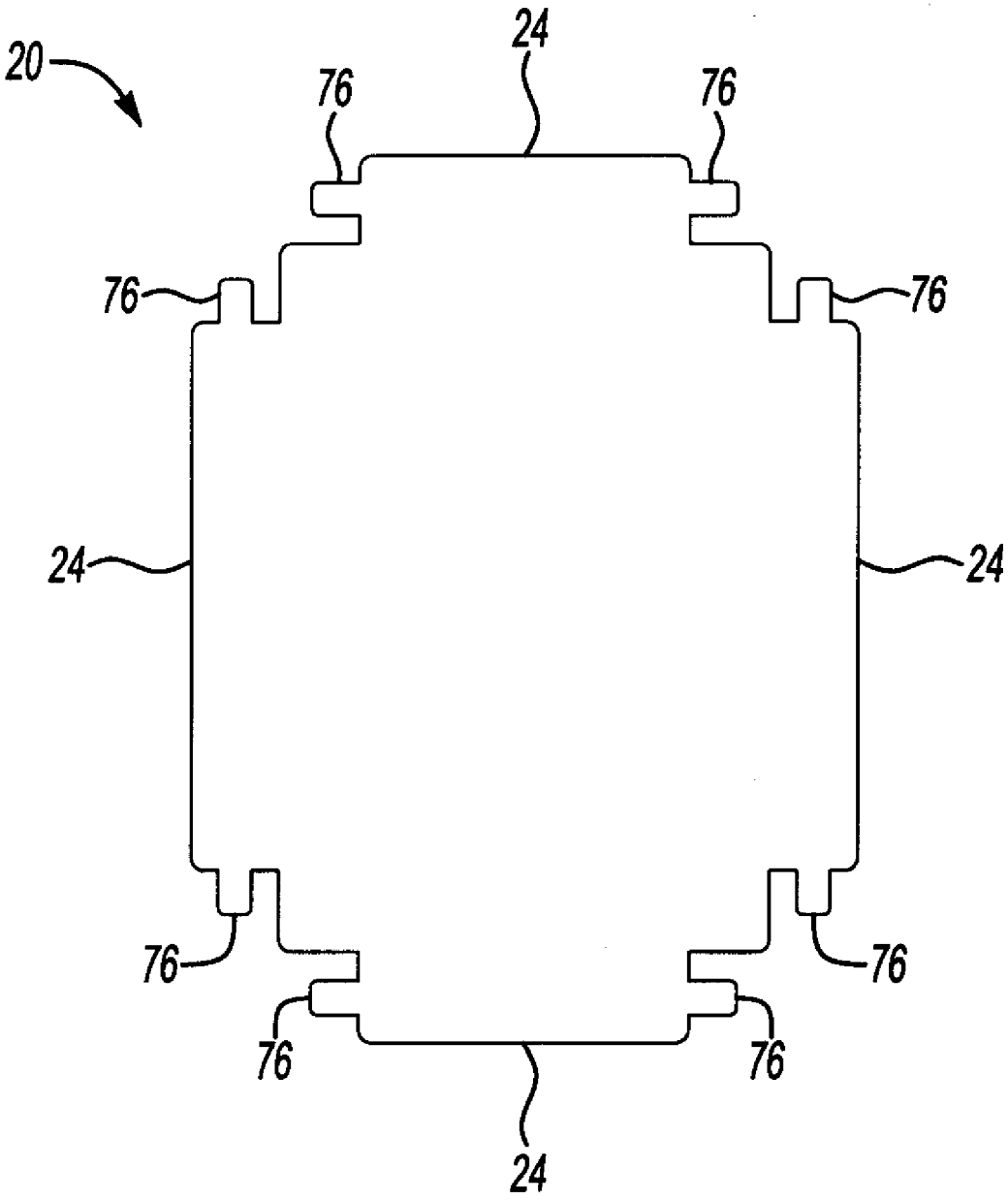
FIGS. 11-13 are schematic views illustrating an alternate embodiment of the process for hemming the inner and outer panels of the loose assembly of panels of FIG. 6 using an alternate embodiment of an electromagnetic forming machine.

In other examples of the method, rather than surround the flanges with a coil to simultaneously bend them to form hems, each flange may be individually bent using an alternate electromagnetic forming machine 58. When using this embodiment of the method, outer panel 20 may be stamped such that each flange includes a plurality of tabs 76, one each at opposite ends of flange 24. (FIG. 11) Tabs 76 are integral with respective flanges 24.

Figure 12:
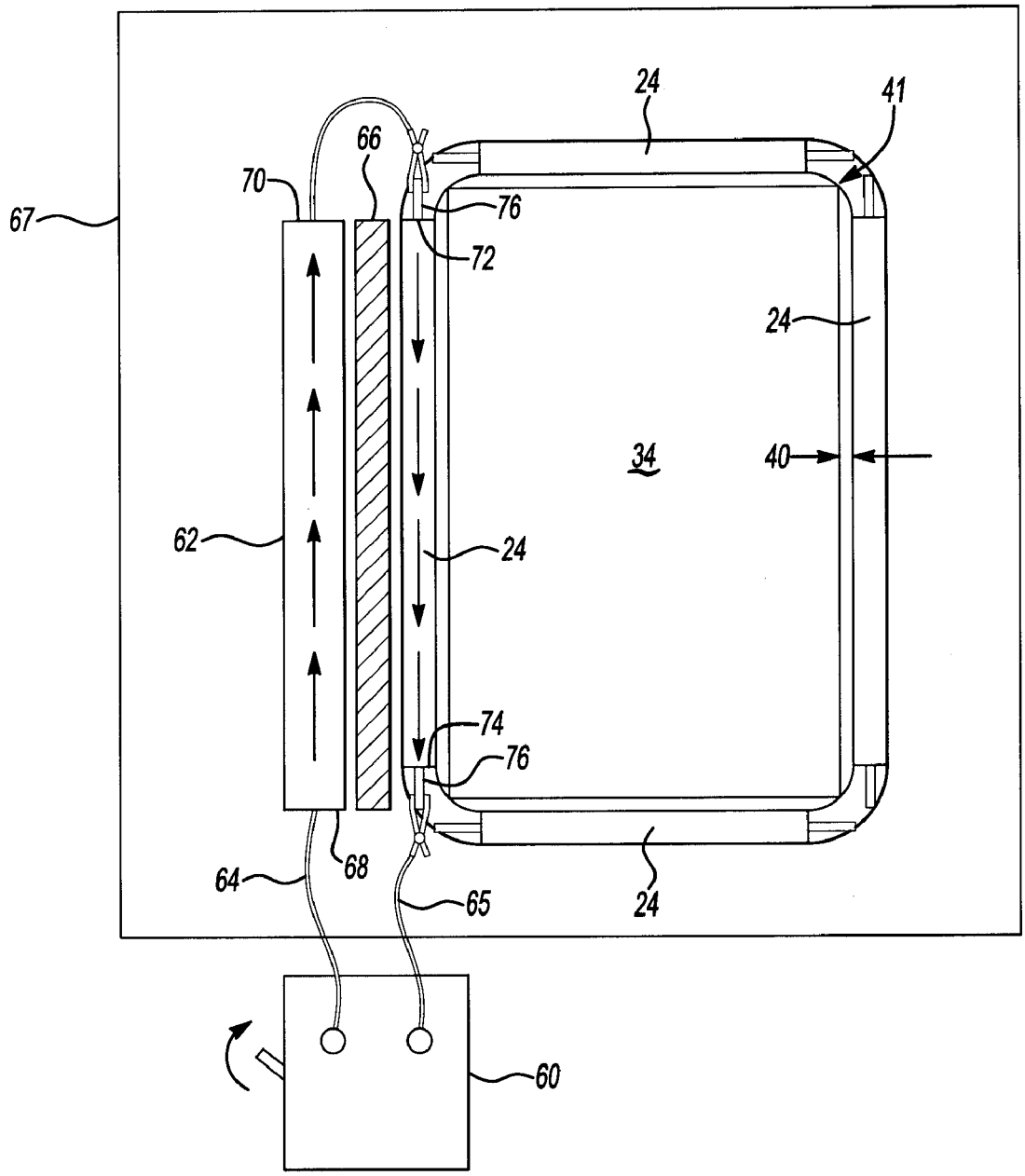

With respect to FIG. 12, electromagnetic forming machine 58 includes an electric current generator 60, a plate 62 and wires 64 (coaxial cable). Optionally, an insulating member 66 may also be included. Electric current generator 60 may include a plurality of capacitors capable of storing a charge and then discharging the charge over a relatively short period of time. Loose assembly of panels 41 may be supported on table 67. Plate 62 includes a first end 68 and a second end 70. Flange 24 includes a second end 72 and a first end 74, each end laying a tab 76. Prior to activation of electromagnetic forming machine 58, wire 64 is connected to first end 68 of plate 62. Second end of plate 62 is electrically connected to tab 76 at second end of flange 72. First end of flange 24 is connected by wire 65 at tab 76 to electric current generator 60. It should be understood that the teachings of the present invention do not require that flanges 24 have tabs 26. For instance, in some embodiments, wires may be attached directly to flange 24.

When electromagnetic forming machine 58 is activated, current generator 60 discharges its capacitors and current flows through wire 64 into plate 62 and travels in a first direction from first end 68 towards second end 70. As the electric current travels from first end 68 to second end 70, a magnetic field propagates outwardly from plate 62. The current continues to flow from second end 70 into second end 72 of flange 24 through tab 76 and travels in a second direction to first end 74 of flange 24. The second direction is opposite to the first direction. As the electric current flows from the second end 72 to the first end 74 of flange 24, a magnetic field is generated that opposes the magnetic field generated by plate 62. When plate 62 is held immobile with respect to loose assembly of panels 41, flange 24 is bent over onto inner panel 34. Electric current flows from second end 74 through tab 76 into wire 65 and back again into current generator 60. In some embodiments, tab 76 may be notched or otherwise weakened such that it breaks off of flange 24 as flange 24 bends to form a hem. In other embodiments, a cutting edge may be presented proximate flange 24 such that tab 76 is sheared off as flange 24 bends to form a hem.

Figure 13:
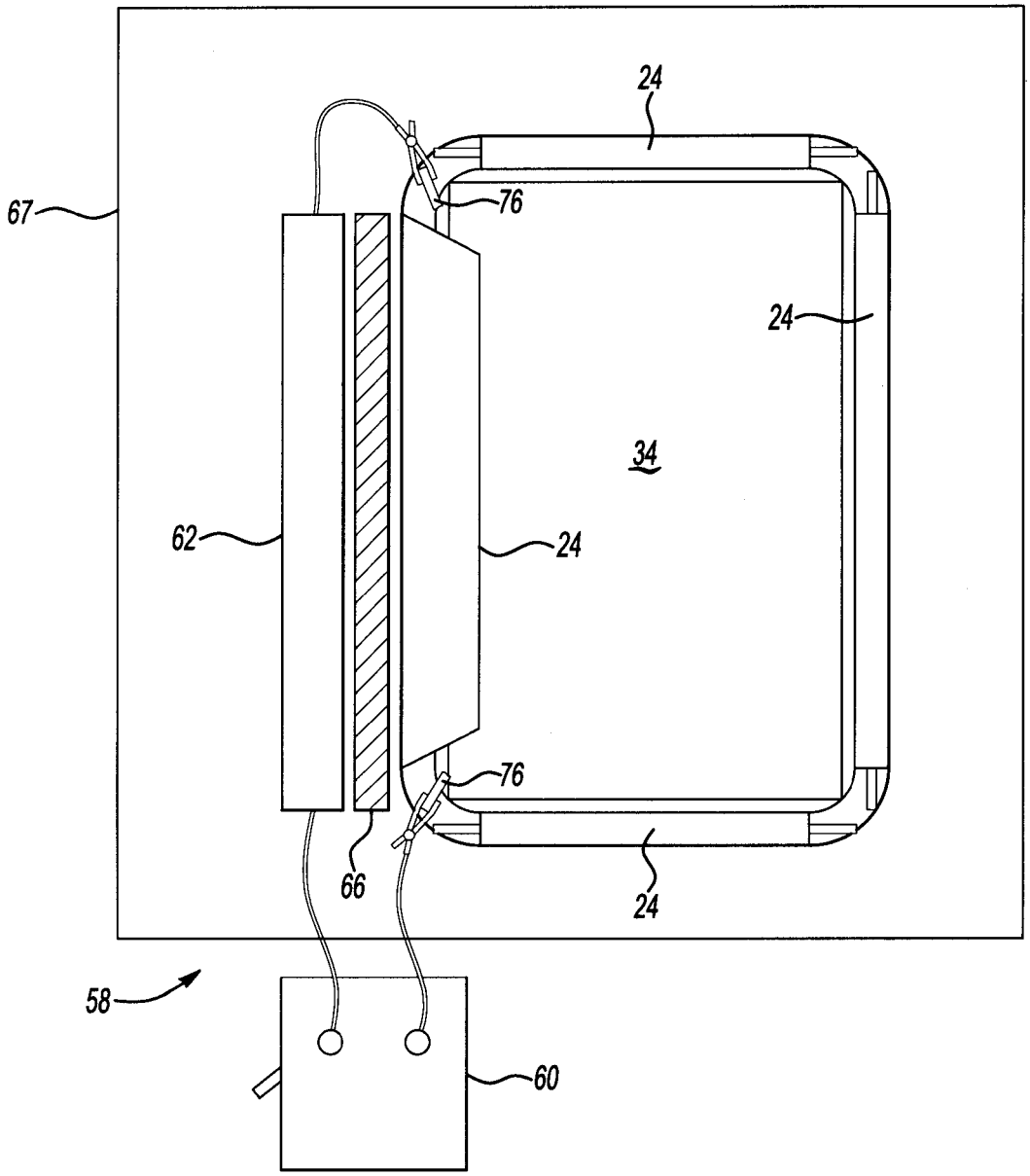

With respect to FIG. 13, a loose assembly of panels 41 is illustrated after activation of electromagnetic forming machine 58. Flange 24 has been bent over onto inner panel 34 to form a hem. Tabs 76 have torn off of flange 24 and the electrical connection between plate 62 and flange 24 and between flange 24 and electric current generator 60 has been broken. This process may be repeated for each flange 24.

While the best mode for carrying out the invention has been described in detail, those familiar with the art to which this invention relates will recognize various alternative designs and embodiments for practicing the invention as defined by the following claims.

What is claimed:

1. A method of using an electromagnetic forming machine to hem a plurality of panels to form a panel assembly, the method comprising:

providing an inner panel having an outer edge;

providing an outer panel having a central portion, a plurality of flanges disposed about a periphery of the central portion, and a plurality of relief areas, each relief area being disposed between adjacent flanges and each relief area having an upper surface;

providing an electromagnetic forming machine having a coil for discharging electric energy to generate an electromagnetic force;

positioning the inner panel adjacent the outer panel such that portions of the outer edge of the inner panel are aligned with the flanges of the outer panel and spaced apart therefrom to form a loose assembly of panels;

positioning the loose assembly of panels proximate the electromagnetic forming machine such that the coil surrounds the plurality of flanges and is disposed generally below a plane formed by the upper surface of the plurality of the relief areas;

wherein the coil is a single turn coil that has a varying cross section along a length of the single turn coil such that the single turn coil comprises a plurality of thick portions and a plurality of thin portions and wherein during the step of positioning the loose assembly of panels, the thin portions are aligned with the relief areas; and activating the electromagnetic forming machine to generate an electric current in the coil which induces an opposing electric current in each of the flanges whereby each of the flanges are bent over the outer edge of the inner panel to form a hem.

2. The method of claim 1 wherein during the step of positioning the loose assembly of panels proximate the electromagnetic forming machine, the loose assembly of panels is disposed such that no portion of the coil protrudes above the plane formed by the upper surface of the plurality of relief areas.

3. The method of claim 1 wherein an upper surface of each of the thin portions is positioned below the plane formed by the upper surface of each of the relief areas.

4. The method of claim 3 wherein an upper surface of at least some of the thick portions extends above the plane formed by the upper surface of each of the relief areas.

5. The method of claim 1 further comprising the step of clamping the inner panel and the outer panel together after the inner panel has been positioned adjacent the outer panel.

6. A method of using an electromagnetic forming machine to hem a plurality of panels to form a panel assembly, the method comprising:

providing an inner panel having an outer edge;

providing an outer panel having a central portion, a plurality of flanges disposed around a periphery of the central portion, and a plurality of relief areas, each relief area being disposed between adjacent flanges;

providing a double action press;

providing an electromagnetic forming machine having a single turn coil for discharging electric energy;

positioning the outer panel in the double action press;

bending the flanges of the outer panel with the double action press until the flanges are disposed in a non-coplanar angular orientation with respect to the central portion;

positioning the inner panel adjacent the outer panel such that portions of the outer edge of the inner panel are aligned with the flanges of the outer panel and spaced apart therefrom to form a loose assembly of panels;

positioning the loose assembly of panels proximate the electromagnetic forming machine such that the single turn coil surrounds the plurality of flanges and is disposed generally below a plane formed by an upper surface of the plurality of relief areas;

wherein the single turn coil has a varying cross section along a length of the single coil such that the single turn coil comprises a plurality of thick portions and a plurality of thin portions and wherein during the step of positioning the loose assembly of panels, the thin portions are aligned with the relief areas; and activating the electromagnetic forming machine to generate an electric current in the single turn coil which induces an opposing electric current in each of the flanges whereby each of the flanges are bent over the outer edge of the inner panel to form a hem.

7. The method of claim 6 wherein during the step of positioning the loose assembly of panels proximate the electromagnetic forming machine, the loose assembly of panels is disposed such that no portion of the coil protrudes above the plane formed by the upper surface of the plurality of relief areas.

8. The method of claim 6 wherein an upper surface of each of the thin portions is positioned below the plane formed by the upper surface of each of the relief areas.

9. The method of claim 8 wherein an upper surface of at least some of the thick portions extends above the plane formed by the upper surface of each of the relief areas.

10. The method of claim 6 further comprising the step of clamping the inner panel and the outer panel together after the inner panel has been positioned adjacent the outer panel.

11. The method of claim 6 wherein the flanges are bent until they are disposed substantially perpendicular to the central portion.

12. A method of using an electromagnetic forming machine to hem a plurality of panels to form a panel assembly, the method comprising:

providing an inner panel having an outer edge;

providing an outer panel having a central portion, a plurality of flanges disposed around a periphery of the central portion at a non-coplanar angular orientation with respect to the central portion, each flange having a first end and a second end, and the outer panel further having a plurality of relief areas, each relief area being disposed between adjacent flanges;

providing an electromagnetic forming machine having a plate for directing the flow of electric current, the plate having a first end and a second end, the electromagnetic forming machine further having a current generator, the current generator directing current into the first end of the plate when the electromagnetic forming machine is activated, wherein one of the flanges includes a first tab protruding from the first end and a second tab protruding from the second end and wherein the second end of the plate is electrically connected to the second tab and wherein the current generator is connected to the first tab;

positioning the inner panel adjacent the outer panel such that portions of the outer edge of the inner panel are aligned with the flanges of the outer panel and spaced apart therefrom to form a loose assembly of panels;

positioning the plate of the electromagnetic forming machine proximate one of the flanges;

electrically connecting the second end of the plate to the second end of the one of the flanges;

electrically connecting the first end of the one of the flanges to the current generator of the electromagnetic forming machine;

activating the electromagnetic forming machine to direct an electric current that travels from the current generator to the first end of the plate to the second end of the plate to the second end of the one of the flanges to the first end of the one of the flanges and back to the current generator whereby opposing magnetic fields are produced by the plate and the flange, respectively, which repel one another and which force the flange to bend over the outer edge of the inner panel to form a hem.

13. The method of claim 12 wherein the plate is disposed substantially parallel to the one of the flanges when the plate is positioned proximate the one of the flanges.

14. The method of claim 12 wherein the method further comprises the step of disposing an insulating member between the plate and the one of the flanges.

15. The method of claim 12 wherein the first and second tabs are sheared off as the flange bends over the outer edge of the inner panel when the hem is formed.

* * * * *